United States Patent [19]

Yang

[11] Patent Number: 5,023,035

[45] Date of Patent: Jun. 11, 1991

[54] CYCLIC TENSIONING OF NEVER-DRIED YARNS

[75] Inventor: Hung H. Yang, Richmond, Va.

[73] Assignee: E. I. Du Pont de Nemours and Company, Wilmington, Del.

[21] Appl. No.: 312,653

[22] Filed: Feb. 21, 1989

[51] Int. Cl.[5] ..... D01F 6/60; D01D 10/06

[52] U.S. Cl. ..... 264/184; 264/205; 264/210.8; 264/211.15; 264/211.16; 264/233; 264/210.7

[58] Field of Search ..... 264/184, 203, 205, 210.8, 264/289.3, 210.7, 290.5, 233

[56] References Cited

U.S. PATENT DOCUMENTS

| | | | |
|---|---|---|---|
| 3,767,756 | 10/1973 | Blades | 264/184 |
| 4,298,565 | 11/1981 | Yang | 264/181 |
| 4,340,559 | 7/1982 | Yang | 264/181 |
| 4,842,796 | 6/1989 | Matsui et al. | 264/184 |
| 4,859,393 | 8/1989 | Yang et al. | 264/184 |

FOREIGN PATENT DOCUMENTS

| | | |
|---|---|---|
| 55-11763 | 3/1980 | Japan . |
| 55-11764 | 3/1980 | Japan . |
| 60-88117 | 5/1985 | Japan . |
| 60-17113 | 11/1985 | Japan . |
| 61-167015 | 7/1986 | Japan . |

OTHER PUBLICATIONS

Mol. Cryst. Liq. Cryst., 1987, vol. 153, pp. 547–552, Roche et al.

*Primary Examiner*—Hubert C. Lorin

[57] ABSTRACT

A process is disclosed for preparing high tenacity, high modulus, para-aramid fibers by application of cyclic tensioning forces to such fibers in the newly-spun, wet, state before they have been dried.

6 Claims, 2 Drawing Sheets

CYCLIC TENSIONING OF NEVER-DRIED YARNS

BACKGROUND OF THE INVENTION

1. Field of the Invention

This invention relates to an improved process for preparing fibers of aromatic polyamides whose chain extending bonds are coaxial or parallel and oppositely directed. The process relates primarily to application of cyclic tensioning forces to such fibers in the wet state before they have been dried.

2. Description of the Prior Art

*Mol. Cryst. Liq. Cryst.*, 1987, Vol. 153, pp. 547–552, Roche et al. is concerned with macrostructural deformation of para-aramid fibers by application of tensile stresses to completely dried fibers and discloses a relationship between altered molecular macrostructure and modulus in dried fibers by application of a cycled stress.

Japanese Laid-Open Patent Application (Kokai) 60/17,113 naming Teijin as the applicant, discloses a process for hot drawing dry copolyamide fibers to as much as six times their original length at greater than 300° C. It is, also, recommended that a preliminary single drawing of from 1.03–3.0X should take place on the wet fibers, before drying. It is said that such preliminary drawing causes individual filaments to remain separated from other filaments and to maintain their round cross section during the hot drawing. No cyclic drawing of never-dried fibers is suggested.

Japanese Laid-Open Patent Applications (Kokai) 85/88,117 and 86/167,015 and Japanese Patent Publications 80/11,764 and 80/11,763 all teach preparation of para-aramid fibers wherein there is a single drawing step applied to the fibers before drying. There is no suggestion that more than a single drawing step should be applied.

SUMMARY OF THE INVENTION

The present invention provides an improved process for preparing high tenacity, high modulus para-aramid fibers wherein the as-spun fibers, in the form of yarn bundles, are washed and drawn through at least two cycles of tensioning forces at about 5° to 50° C. while containing at least 20% water. The cycles comprise the tensioning forces followed by relaxations. During relaxations, the tensioning forces are reduced to 0 to 25% of the maximum tensioning force.

The invention yields fibers of very high modulus and tenacity. The process is characterized by requiring at least two, and preferably three to ten, cycles of tensioning forces on so-called "never-dried" yarns.

Preferably the para-aramid fibers are made from poly(p-phenylene terephthalamide), but any aromatic polyamide fiber can be used so long as it has been spun from an anisotropic solution of the polyamide in 98.0 to 100.2% sulfuric acid having a polyamide concentration of at least 30 g/100 ml sulfuric acid through a layer of non-coagulating fluid into a coagulating bath to yield fibers, such as is described in U.S. Pat. Nos. 3,767,756; 4,298,565; and 4,340,559.

DETAILED DESCRIPTION OF THE INVENTION

Figure 1B:
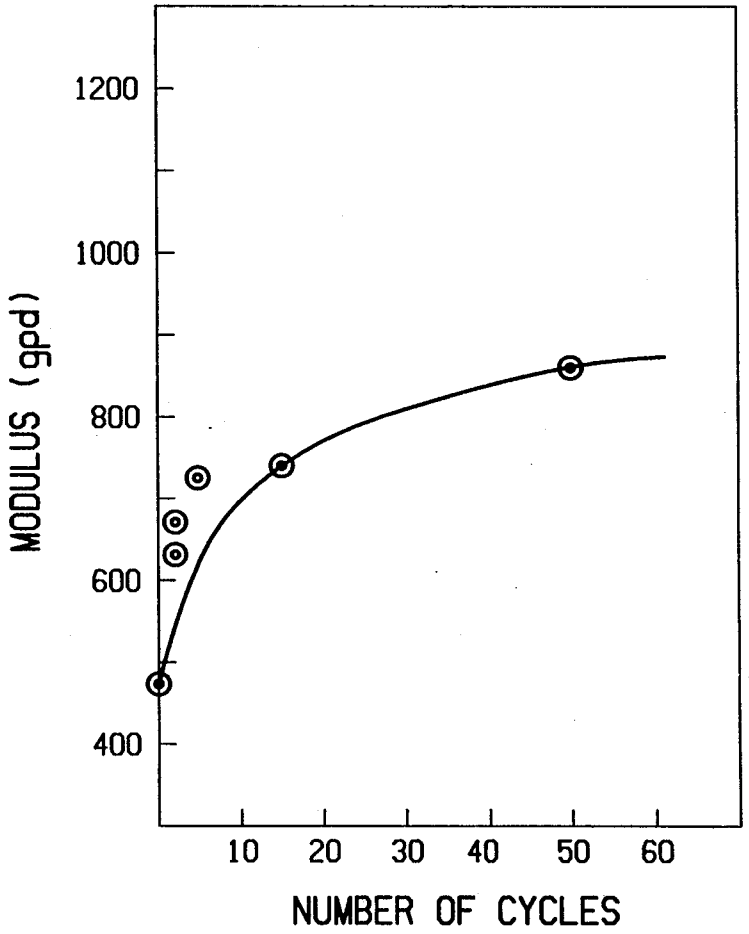
FIGS. 1*a* and 1*b* are graphical representations of improvement in fiber tenacity and modulus which is realized by the cyclic application of tensioning forces to never-dried fibers in accordance with this invention.

The process of the present invention can be conducted on any never-dried para-aramid fibers made from any para-aramid polymeric material. Poly(p-phenylene terephthalamide) homopolymer is preferred and, by "poly(p-phenylene terephthalamide)" is meant the homopolymer resulting from equimolar polymerization of p-phenylene diamine and terephthaloyl chloride and, also, copolymers resulting from incorporation of small amounts of other aromatic diamine with the p-phenylene diamine and of small amounts of other aromatic diacid chloride with the terephthaloyl chloride. As a general rule, other aromatic diamines and other aromatic diacid chlorides can be used in amounts up to as much as about 10 mole percent of the p-phenylene diamine or the terephthaloyl chloride, or perhaps slightly higher, provided only the other diamines and diacid chlorides have no reactive groups which interfere with the polymerization reaction. The fibers can be continuous filaments of any denier.

The cyclic tensioning can be conducted at ambient temperatures less than 50° C. The tensioning forces applied to the yarn should exceed 10% of the never-dried breaking load but should not be so great as to break or to otherwise mechanically damage the yarn. Tensioning forces in the range of 10 to 80% of the breaking load are found to be suitable; and tensioning forces in the range of 20 to 70% of the breaking load are preferred.

The cyclic tensioning must be performed on swollen, uncollapsed, fibers and can be conducted on fibers which have any amount of water, or equivalent liquid, greater than the minimum amount necessary to maintain an uncollapsed structure. As a general rule fibers for the tensioning steps will have from 20 to 100, weight percent, water, based on dry fiber material. If desired or required for a particular purpose, the tensioning steps can be conducted in aqueous acid or other liquid such as may be found in the fiber coagulating bath. The tensioning steps are conducted after fiber coagulation has been completed and before fiber collapse due to drying has occurred.

It is believed that aramid fibers have a microscopically fibrous structure with microfibrils of 20–50 nm in diameter arranged, generally, along the fiber axis. The fibers are believed to have a highly oriented skin and a relatively unoriented fiber core. At the macroscopic level, aramid fibers, particularly of poly(p-phenylene terephthalamide), are believed to have a radially arranged sheet structure of the microfibrils and the radial sheets are believed to be pleated in the direction perpendicular to the fiber axis at a periodicity of about 600 nm. A never-dried aramid fiber has a swollen structure which is saturated with water. In the presence of water as a lubricating medium, the microfibrils can slip and straighten under stress. Thus, a never-dried fiber, by means of cyclic tensioning, can undergo microstructural deformation with an increased degree of crystal orientation in the fiber core without macroscopic structural damage. Prolonged cycling causes the pleated sheet structure to diminish gradually. This leads to improvement in both fiber strength and modulus as has been discovered in the present invention. In contrast, a dried fiber has a collapsed microstructure without free water. Such a fiber can undergo some core orientation but only with a certain degree of microscopic structural damage. This generally leads to noticeable loss of fiber tenacity and increase in fiber modulus.

The cyclic tensioning includes steps of applying tension followed by steps of relaxing the tension. After each step of tension application, the tension is reduced to about 0–25% of the tension just applied.

The cyclic tensioning is followed by drying the tensioned fibers. The drying can be accomplished under tension or in the complete absence of tension. In the case wherein the drying is to be conducted in the absence of tension, a cyclically tensioned yarn can be dried at a temperature of less than 300° C., preferably 120–180° C., in 5–100 sec to a final moisture content of about 4–12%, by weight, of polymer. These conditions result in a yarn product with very high tenacity and moderately high modulus.

In the case wherein the drying is to be conducted under tension, the optimum tension will depend on the overall conditions used. In any case, tension for the drying step should be less than the tension employed in the cyclic tensioning steps. Tensions during drying are 10 to 100% of the maximum cyclic tensioning force; and tensions during drying are preferably 10 to 50% of the maximum cyclic tensioning force. Preferably, drying involves no direct contact with solid surfaces. Drying is conducted at temperatures as low as practical, consistent with the object of drying the fiber with a minimum of damage. The drying under tension is, also, usually conducted at temperatures of more than the temperatures of the cyclic tensioning and less than about 300° C. in 5–100 sec to a final moisture content of 4–12% by weight of polymer. These conditions result in a yarn product with moderately high tenacity and very high modulus.

Figure 1A:
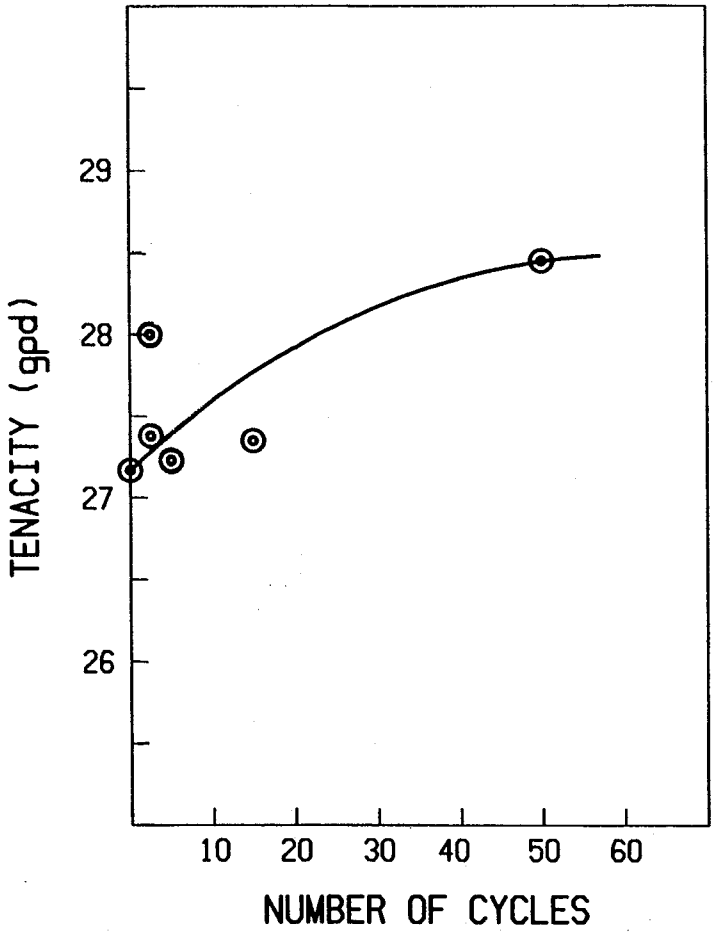

FIGS. 1*a* and 1*b* show that, when a never-dried multi-filament aramid yarn is cyclically tensioned and subsequently dried according to this invention, both its tenacity and modulus improve with the number of tensioning cycles. Generally speaking, the tenacity and modulus of a cyclically tensioned yarn improve rapidly in the first few tensioning cycles and then slightly with additional tensioning cycles. As discussed above, it is believed that cycling leads to an increase in crystal orientation and the gradual diminishing of the pleated sheet structure in the fiber. The fiber may approach maximum tensile properties asymptotically with 20–50 tensioning cycles. Data for the graphs of FIGS. 1*a* and 1*b* are from the Example presented hereinafter.

It is important and critical to practice of this invention that the magnitude of tensioning force be carefully selected for a given yarn on account of variations in never-dried breaking load resulting from variations in polymer composition, fiber crystallinity, orientation, and filament or yarn denier. The breaking load is the tensioning stress at which the never-dried yarn breaks on the machine on which it is being processed; and the maximum tensioning force used in practice of this invention is 10–80% of that breaking load.

Cyclic tensioning force on the fibers is preferably maintained by use of roller pairs with slightly differing rotating speeds. The fibers to be drawn are wrapped around a first roller rotating at some preselected appropriate speed and the fibers are then wrapped around a second roller rotating at some slightly faster speed. The degree of tensioning force to be applied to the never-dried fibers is adjusted by adjustment of the speed of the roller pair. Roller pairs are linked to provide cyclic tensioning. Upon leaving one pair, the never-dried fibers can be wrapped around the first roller of another roller pair having a rotating speed the same or slightly less than the rotating speed of the second roller in the previous pair. The tension is, thus, reduced between the roller pairs. The second roller in the second roller pair is rotated faster that the first roller in the second pair to the degree necessary to achieve the desired tensioning force. Roller pairs can be linked in tandem for as many cycles of tensioning as are desired or required. Alternatively, the rollers in a pair can be rotated at the same speed, but the second roller can be made with a slightly larger diameter than the first so as to induce a tension in the advancing yarn between the rollers. The tensioned yarn is then relaxed and tensioned again when it is advanced to the first roller of a subsequent, similarly designed, roller pair.

Figure 2:
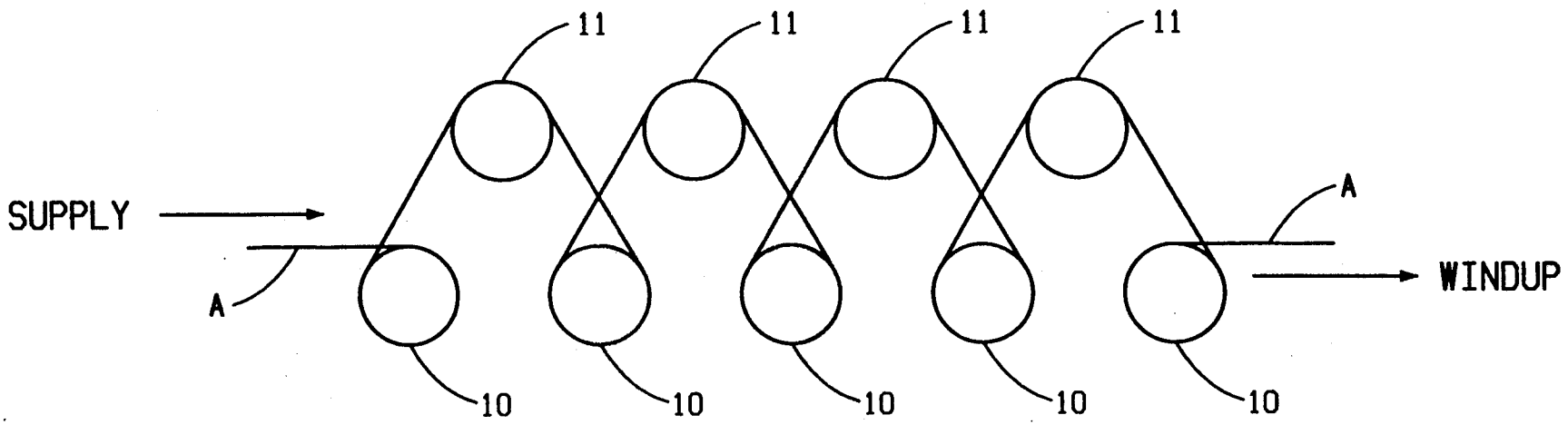
FIG. 2 is a simplified representation of a tensioning device which can be used to apply the cyclic tensioning forces of this invention.

FIG. 2 is a simplified representation of roll means for applying the cyclic tensions of this invention. Yarn A from a supply (not shown) is introduced to relaxing roll 10 turning at a certain rate and from there to tensioning roll 11 turning at a slightly faster rate. The difference in turning rates between the relaxing rolls and the tensioning rolls is selected to achieve the desires degree of tension in yarn A. After tensioning roll 11, the yarn is fed to the next relaxing roll 10 and the difference in turning rates causes a relaxation of the tension on yarn A. In FIG. 2, the yarn A is conducted through four cycles of tension and relaxation before yarn A is taken from the rolls to windup (not shown). It is, also, possible that the cyclic tensioning can be conducted by making tensioning rolls 11 slightly larger in diameter than relaxing rolls 10 with all rolls turned at the same rate.

The roller pairs devices are preferred for conduct of this invention; but alternative means for applying cyclic tensioning can certainly be used. For example, a roller pair can be used for repeated tensioning and relaxing by multiple wrappings. Tapered rollers can be used for programmed tensioning cycles.

The tension for the initial cycle is preferably as high as can be used without causing a high fiber breakage and is, generally, in the range of 10–80% of the breaking load. Subsequent cycles are, also, preferably as high as can be used without causing excessive filament breakage. As a general rule, and for process simplification, all of the tensioning cycles are conducted at the same tensioning forces. Progressively increasing or decreasing tensions can be used, if desired.

After the cyclic tensioning, the fibers are dried. The tension for the drying step depends critically on the type of drying device and process used, and on the type of fiber product being produced. High drying tensions in combination with high drying temperature should be applied carefully so as not to damage the filaments. Steam- or hot gas-heated rolls are generally suitable for high tension drying at reasonable temperatures according to U.S. Pat. No. 4,726,922. Tubular ovens can be operated for high tension, high temperature drying of cyclically tensioned aramid yarns. As discussed earlier, the drying tension and drying temperature may affect the yarn tensile properties. Moderate drying temperature generally favors increase in yarn tenacity, while high drying tension favors increase in yarn modulus.

After drying, the fibers can be packaged in any way desired, such as, for example, by winding the dried yarn on a spool or bobbin. A finish, or water, may be applied to the fibers before packaging.

The process of this invention can be practiced as a continuous or a batch process.

Tests

Moisture on Yarn

While this determination is useful at any stage, it is ordinarily used for yarn immediately as received from a drying step so as to measure effectiveness of the drying. Yarn, as dried, is wound without finish onto a bobbin with enough traverse strokes for four or more yarn layers. On doffing the bobbin, its surface layer is stripped off, a sample long enough to weigh at least 0.5 g is removed, and is immediately placed inside a polyethylene bag which is sealed with tape. Weight of bag, tape, and sample is recorded as $W_1$. The sample is placed in an aluminum cup and heated in an oven at 135° to 140° C. for 30 minutes. Meanwhile, weight of bag and tape is recorded as $W_2$ so that $W_1-W_2$ becomes the weight of the moist sample. The hot sample in its aluminum cup, on removal from the oven, is immediately placed in a nitrogen-blanketed desiccator and cooled 5 minutes. Then the dry yarn sample alone is weighed to obtain $W_3$. The percent moisture on (or in) yarn (% MOY) as originally collected is calculated from:

$$\% \text{ MOY} = 100 \times \frac{(W_1 - W_2) - W_3}{W_3}$$

Linear Density

The denier or linear density of a yarn is determined by weighing a known length of the yarn. Denier is defined as the weight, in grams, of 9000 meters of the yarn.

Tensile Properties

Tenacity is reported as breaking stress divided by linear density. Modulus is reported as the slope of the initial stress/strain curve from 0.1 to 0.4% strain converted to the same units as tenacity. Elongation is the percent increase in length at break. Both tenacity and modulus are first computed in g/denier units which, when multiplied by 0.8826, yield dN/tex units).

Tensile properties for yarns are measured at about 21° C. and about 50–60% relative humidity after conditioning under test conditions for at least 14 hours. The yarn is twisted at a twist multiplier (TM) of 1.1 according to the relationship, $$TM = \frac{tpi\sqrt{\text{denier}}}{73} = \frac{tpc\sqrt{dtex}}{30.3}$$

where tpi=turns per inch and tpc=turns per centimeter.

A gage length of 10 inches (25.4cm) is used with an elongation rate of 0.25 cm per minute.

In actual practice, the measured denier of a yarn sample, test conditions and sample identification are fed into a computer before the start of a test; the computer records the load-elongation curve of the yarn as it is broken and then calculates the properties.

Inherent Viscosity

Inherent viscosity ($\eta_{inh}$) is measured at 30° C. and computed from $$\eta_{inh} = \ln (t_1/t_2)/c$$

where $t_1$=solution flow time in the viscometer $t_2$=solvent flow time in the viscometer c=polymer concentration of 0.5 g/dL, and the solvent is concentrated sulfuric acid (95–99 wgt %).

DESCRIPTION OF THE PREFERRED EMBODIMENT

A spin dope was prepared from poly(p-phenylene terephthalamide) of inherent viscosity 5.6 dL/g using 100.1% sulfuric acid to provide an anisotropic solution containing 19.4% by weight polymer (44.5 g polymer/100 ml sulfuric acid). The spin dope was deaerated and extruded at 80° C. through a spinneret having 1000 holes, each with a diameter of 0.0633 mm. The extruded solution was passed through an air gap of 6.4 mm into a coagulation bath of about 5%, by weight, aqueous sulfuric acid at 2°–5° C. The coagulating or quenching device was as described in U.S. Pat. No. 4,340,559, with a jet device. Yarn was withdrawn from the quenching device at about 400 ypm (365.8 m/min.) and washed and neutralized on two sets of rolls with water spray on the first set and dilute caustic spray on the second set. The wet, neutralized, yarn was wound up on a 4 inch plastic tube at a tension of about 0.2 gpd. The yarn was determined to have 25–35% moisture and the wound yarn package was placed in two layers of 2-mil polyethylene bag to prevent it from drying.

To demonstrate the improved tenacity and modulus of yarns prepared according to this invention, samples of the yarn spun and coagulated above, were subjected to cyclic tensioning in a tensile testing device and then were evaluated to determine their tensile properties. The yarns, after cyclic tensioning, were dried in air to 8–10% moisture at no tension, and were twisted at 2.1 turns per inch prior to the tensile tests. A control sample of the yarn was treated in the same way but without any cyclic tensioning. Results of the testing are shown in the table below and in FIGS. 1*a* and 1*b*.

The breaking load for the never-dried fibers was determined to be 33.0 kg; and the cyclic loads applied to the yarns in the various runs ranged from 22.1 to 25.8 kg. Between cycles, the fibers were relaxed to zero tension.

TABLE

| Value | Control | A | B | C | D | E |
|---|---|---|---|---|---|---|
| Cyclic Load (kg) | — | 22.1 | 22.1 | 25.8 | 25.8 | 25.0 |
| No. of Cycles | 0 | 2 | 5 | 2 | 15 | 50 |
| Cycle Rate (mm/min) | — | 20 | 20 | 35 | 20 | 50 |
| Tenacity (gpd) | 27.4 | 28.1 | 27.6 | 27.9 | 27.4 | 28.8 |
| Elongation (%) | 4.2 | 3.7 | 3.3 | 3.4 | 3.2 | 2.9 |
| Modulus (gpd) | 470 | 629 | 718 | 664 | 742 | 862 |

I claim:

1. A process for preparing high tenacity, high modulus fibers of para-aramid having an inherent viscosity of at least 4.0 whose chain extending bonds are coaxial or parallel and oppositely directed, comprising the steps of:

(a) extruding an anisotropic solution of the para-aramid in 98.0 to 100.2% sulfuric acid having a para-aramid concentration of at least 30 g/100 ml sulfuric acid through a layer of non-coagulating fluid into a coagulating bath to yield fibers;

(b) washing the fibers; and (c) applying at least two cycles of tensioning forces to the washed fibers at a temperature of 5° to 50° C. having at least 20% moisture, wherein the tensioning force in the first cycle is 10 to 80% of the never-dried breaking load followed by a relaxation to 0 to 25% of the first tensioning force and subsequent tensioning forces are 10 to 80% of the never-dried breaking load followed by subsequent relaxations to 0 to 25% of the tensioning forces.

2. The process of claim 1 wherein there is the additional step of:

(d) drying the fibers, after the cycles of tensioning forces of step (c), at a temperature of less than 300° C. until the fibers have a moisture content of from about 4 to 12%.

3. The process of claim 2 wherein the tension on the fibers during the drying is 10 to 100% of the first tensioning force.

4. The process of claim 1 wherein the para-aramid is poly(p-phenylene terephthalamide).

5. The process of claim 2 wherein the para-aramid is poly(p-phenylene terephthalamide).

6. Process of claim 4 wherein there are at least three cycles of tensioning forces.

* * * * *